US006977031B1

(12) United States Patent
Jakovac et al.

(10) Patent No.: US 6,977,031 B1
(45) Date of Patent: Dec. 20, 2005

(54) ANODE ASSEMBLY

(75) Inventors: Vjekoslav Jakovac, Victoria (AU); Vladimir Kanovnik, Victoria (AU); Drago Juric, Victoria (AU)

(73) Assignee: SRA Technologies Pty Ltd., East Melbourne (AU)

( * ) Notice: Subject to any disclaimer, the term of this patent is extended or adjusted under 35 U.S.C. 154(b) by 435 days.

(21) Appl. No.: 10/049,242

(22) PCT Filed: Aug. 11, 2000

(86) PCT No.: PCT/AU00/00959

§ 371 (c)(1),
(2), (4) Date: May 16, 2002

(87) PCT Pub. No.: WO01/12881

PCT Pub. Date: Feb. 22, 2001

(30) Foreign Application Priority Data

Aug. 13, 1999 (AU) ..... PQ2188

(51) Int. Cl.[7] ..... C25B 11/00

(52) U.S. Cl. ..... 204/280; 204/243.1; 204/245; 204/247.3; 204/247.5; 29/745; 29/746; 29/825; 29/874

(58) Field of Search ..... 204/280, 243.1, 204/245, 247.3, 247.5; 205/380, 381; 29/825, 29/874, 745, 746

(56) References Cited

U.S. PATENT DOCUMENTS 4,379,033 A 4/1983 Clark et al.
5,538,607 A * 7/1996 Pate ..... 204/280

FOREIGN PATENT DOCUMENTS

AU 81194/87 6/1988
GB 2 159 538 A 12/1985

* cited by examiner

*Primary Examiner*—Bruce F. Bell
(74) *Attorney, Agent, or Firm*—Pillsbury Winthrop Shaw Pittman LLP

(57) ABSTRACT

An anode assembly for conducting electrical energy to an electrolytic smelting cell including an anode of high electrically conductive material connected to a yoke, the ends of the yoke being receivable within anodes, the yoke including a core of highly electrically conductive material and an outer structural sheath extending substantially the length of the yoke, the anode rod being in electrical contact with the core of the yoke and provided with a protective structural collar secured to the outer structural sheath of the yoke. In order for the electrical and thermal contact between the core and sheath to be maintained, the differential coefficient of thermal expansion over the operating temperature range of the assembly is preferably substantially the same or within $4\times10^{-6}$ m/mk.

36 Claims, 4 Drawing Sheets

ANODE ASSEMBLY

FIELD OF THE INVENTION

This invention relates to an anode assembly for an electrolytic metal smelting cell and is particularly suited to the electrolytic refining of aluminium from alumina.

BACKGROUND OF THE INVENTION AND PRIOR ART

The majority of the world aluminium production takes place in electrolytic smelting cells employing the Hall-Heroult Process. In this process direct current is passed through a molten salt bath at a temperature of approximately 970° C. in which alumina is dissolved. The bath consists of a mixture of fluoride salts in which the main component is cryolite ($Na_3AlF_6$). As the electrolysis takes place in a molten salt at a high temperature in a corrosive environment, the service conditions for various electrical components of the electrolytic cell are arduous.

The molten bath in which the alumina is dissolved is contained within an electrolytic cell. The typical electrolytic cell comprises a rectangular steel shell lined with refractory materials as insulation, and carbon on the hot face. The carbon blocks on the bottom of the cell contain embedded conductors for the collection of current and act as the cathode. Carbon anodes are suspended from above the cell and dip into the bath. Metallic conductors known as anode assemblies or anode rods provide the mechanical support and carry the current to the anodes. The current design of the anode assembly is based on a steel structure attached to a carbon anode block. The steel structure is connected to the electrical bus bar via a copper or aluminium bar. The overall electrical resistance of a conventional anode assembly comprises the anode bar ohmic resistance, the steel structure (yoke) ohmic resistance and transition resistance between the steel structure and the anode bar.

During cell operation the bath is kept molten by the heat generated by the passage of electric current. The anodes are covered by a mixture of alumina and crushed bath to protect the anodes, particularly the connection points between the assemblies and carbon from airburn. During the process oxygen is released at the anodes where it reacts with carbon to produce mainly $CO_2$ gas and release small amounts of CO and $SO_2$.

In order to add alumina to the cell, the protective crust is first broken and the alumina added through the hole in the crust. As the fresh alumina contains a small amount of moisture in the alumina, fluorides and chlorides in the molten bath releasing a cocktail of gases ($SO_2$, CHI an HF) which at elevated temperatures can be highly corrosive with respect to anode assemblies. The $CO_2$ gas released at the electrolytic face is highly oxidising with respect to the consumption of carbon on the sides of the anode and on the hot faces of the anode which are exposed to the pot atmosphere below the crust and ore cover. This consumption of carbon from the anode sides reduces the life of the cell and represents an additional cost to the process.

Conventional aluminium reduction plants require a large infrastructure, typically costing above US$4000 per tonne of installed capacity and a large amount of electrical energy and carbon. The arduous service conditions within the cell impose expensive maintenance requirements on pots and anode assemblies. By increasing the production capacity of the existing plants and reducing the consumption of electrical energy and carbon and by reducing the need for anode assembly maintenance, a reduction of cost of aluminium production can be achieved.

An improvement on the conventional anode assembly is shown in U.S. Pat. No. 5,538,607. U.S. Pat. No. 5,538,607 discloses an anode assembly comprising an anode bar of high electrically conductive material. The end of a leg of the anode bar is received within a steel sleeve or stub and the stub inserted into a carbon anode block. While the anode assembly of U.S. Pat. No. 5,538,607, in theory is able to provide a high electrically conductive anode assembly which is easily maintained, the design does not address the practical problems faced in the application of an electrolytic cell such as oxygen burn out or anode block submersion.

SUMMARY OF THE INVENTION

The present invention is directed to an anode assembly construction for supporting anodes particularly adapted for use in the existing Hall-Heroult cell applications.

Accordingly the invention provides an anode assembly for conducting electrical energy to an anode of an electrolytic smelting cell comprising an anode bar of high electrically conductive material, a yoke electrically connected to said anode bar, and anode stubs fitted to the ends of said yoke, said yoke comprising a core of highly electrically and thermally conductive material and an outer structural sheath extending at least over the ends of said core, said outer structural sheath having substantially the same thermal expansion characteristics as the core material over the operating range of temperatures of said anode assembly.

The yoke of the anode assembly of the present invention is preferably formed from a core material of high electrical and thermal conductivity such as high purity copper nickel or aluminium. Accordingly, the electrical and thermal conductivities of the core materials are preferably with the range of 5–70 ($1/\mu\Omega m$) and 80–400 W/mK respectively An outer protective sheath of high temperature structural material with substantially thermal expansion properties, such as austenitic or ferritic stainless steels spheroidal graphitic iron and carbon steel preferably extends over at least the ends of the core.

The materials of the core and sheath are said to have substantially the same thermal expansion properties when the net expansion of both materials as a result of heating to operating temperature can be absorbed by elastic deformation of the materials with no loss of contact thermally or electrically between the materials.

By having the sheath material and core made of material having substantially the same thermal expansion properties, the metals can expand at approximately the same rate over the range of operating temperatures of the anode assembly in the smelting cells. This enables the good electrical contact between the sheath and core to be maintained ensuring a high possible current density to the anode during operation. It also enables good thermal conduction contact to be maintained allowing heat to be conducted away from the anode block.

The applicants have found that by having the core and sheath formed of materials with substantially the same thermal expansion characteristics over the operating range of temperatures, the combination of the resulting strain of the materials (due to expansion) at operating temperature and the maximum yield stress can be accommodated within the system whilst avoiding plastic deformation or differential movement. This may be accomplished by selecting core and sheath materials which have a differential co-efficient of thermal expansion of less than $4\times10^{-6}$ m/mk and preferably controlling the strain to maintain the maximum stress to below the yield stress of the weaker material. It is intended that a differential co-efficient of thermal expansion of less than $4\times10^{-6}$ m/mk is within the scope of substantially the same thermal expansion characteristics in the context of the invention. Controlling the maximum service temperature can preferably limit the strain to less then 0.2%.

In a preferred form of the invention, the outer protective sheath extends over substantially the length of the yoke. The yoke which is preferably U-shaped and the core sealed within the outer protective sheath. The sheath material provides the high temperature strength and resistance to hot corrosive gases, and the core material, free from mechanical duties. As stated earlier maintaining good thermal and electrical contact between the components particularly the core and sheath provides for conduction and distribution of current from the assembly to the carbon and heat from the carbon to the pot atmosphere. Furthermore, the internal joins and electrical contact interfaces between the conductive core and outer sheath are completely protected from ingress of oxygen and other corrosive gases preferably by welding the core within the sheath.

The lower part of the assembly which is in intimate contact with the carbon anode block preferably consists of stubs having a larger diameter to the yoke. These stubs may have a thicker sheath, which serves to distribute the current across the interface and to act as a thermal insulator. In this way the amount of heat extracted from the process can be controlled and the core having a lower melting temperature protected from extreme temperatures which occur when an anode is incorrectly set, or slips in the clamp. Furthermore there may be a thermally insulating disc inside the stub at the bottom of the core, whose function is to further control process heat incursion by having heat flow only through the sides of the stubs.

"Dropped" anodes are known to be the main causes of anode "burn-offs" in the electrolytic refining process. Burn-offs occur when an anode draws a high current, well above its normal current, and generates so much heat internally that the cast iron thimble or stub, which secures the carbon block to the assembly, melts (1100° C.) and the anode separates. Burn-offs represent a major disturbance to the process requiring unscheduled anode changes and usually result in anode assembly damage.

The strategy commonly used in burn-off prevention is based on using electrical signal noise (pot noise) to detect possible existence of dropped anodes. The control system responds to this problem through a sequence of automatic responses. When this sequence is exhausted an alarm is raised and manual intervention requested. Depending on the work flow and other activities, pot operators may respond immediately, or in due course. The usual operator response is to manually check all anode assemblies in the pot in order to detect the problem anode and to action it. If the dropped anode is detected sufficiently early, the anode can be raised and no further damage is sustained. If however the burn-off threshold of the anode is low, it usually burns off by the time the alarm is raised. Therefore to reduce the incidence of burn-offs, the problem anodes must have a high burn-off threshold. The magnitude of a disturbance due to a "dropped" anode must be sufficiently large (high current draw by one anode) to be identified as a possible anode problem and such high current drawing anodes must survive under this stressed high current condition long enough, for the problem to be corrected. By maintaining good thermal contact between the components of the anode assembly over the range of operating temperatures, heat can be conducted away from anode block and stubs at a much faster rate than would be the case if gaps were to appear between the components due to thermal expansion. Hence the anode assembly of the present invention is designed to have a much higher burn-off threshold and a much higher assembly damage threshold, when compared to conventional anode assemblies.

In a preferred form of the invention, the yoke is substantially U-shaped. The yoke is preferably formed from a round rod, made of a material with a high electrical and a high thermal conductivity, inserted into a thin walled sheath of corrosion resistant material, which has a high temperature strength. Electrical grade copper is the preferred conductor material, whereas various grades of stainless steel are preferred sheath material, although mild steel or high carbon boiler tube can be used. The sheath (or in some cases the copper rod) maybe tapered on both ends and metallised with a brazing compound before being assembled. The anode assembly may further comprise stubs, which receive the tapered ends of the yoke. The stubs are preferably of tubular construction and have a receiving taper machined into them. This taper is designed to achieve compression of contact surfaces and leave a gap between the bottom of the stub and the bottom of the core. The yoke is pressed into the stubs with a very high load (>100 tonnes), which results in the compression of the joints between the core and sheath and between the sheath and stubs which also assists in maintaining contact between the components during heating. The combination of pressure and taper are designed to achieve a partial expansion of the stubs. The tops of the stubs are then secured to the sheath by welding.

The pressed assembly then may be preheated in a furnace and the previously sprayed brazing compound wets and spreads over all contact surfaces and thus, under capillary action, achieves filling and sealing of any interfacial gaps. This creates an excellent electrical contact and achieves the exclusion of oxygen from contact surfaces. A metal plug may be provided to close the bottom of the stub and an insulating disc made of compressed ceramic fibre insulation may be placed into the space between the core and the metal plug. The stub bottom then may be sealed by circumferential welding of the plug to the stub. Alternatively, an air gap can be left below the core in the stub to also provide insulation.

As with the contact between the core and the sheath, it is highly desirable for the sheath and the stubs to be formed from materials which have substantially the same thermal expansion characteristics over the operating ranges. Accordingly, the differential co-efficient of thermal expansion between materials preferably does not exceed $4\times10^{-6}$ m/mk.

In accordance with another aspect of the invention there is provided the anode assembly of claim 24 wherein the core (29) is produced from a metal having electrical and thermal conductivities in the ranges of 5–70 ($1/\mu\Omega$m) and 80–400 W/mK respectively.

By providing an anode assembly in which the contacting metals are compatible, stepped changes in characteristics can be attained between the materials of the core and the sheath and the sheath and the stubs allowing the use of materials in the core and the stubs which otherwise would not have been compatible under the operating conditions.

In order to provide mechanical strength and toughness to the assembly a flared protective structural collar extends over the stems of the anode rod and secured to the sheath of the yoke. The collar allows a certain degree of flexing in the yoke, but resists plastic deformation. The collar may be attached to the conductive anode stems by mechanical indentation and secured by means such as welding. Mechanical indentation provides a mechanical anchorage of the assembly in case of weld failure and at the same time reduces stress on welds to reduce the likelihood of such failure. The securement of the collar to the yoke seals the yoke and excludes the possibility of oxygen ingress from the top.

In the conventional anode assembly, the yoke is of a rigid construction, usually made from cast steel, and depending on its size and operating temperature, can either cause the carbon blocks to crack or result in yielding and plastic deformation of high temperature softened, mild steel stubs. This plastic deformation of the assembly increases with each cycle, leading to problems with stub toe-in. This requires the conventional anode assemblies to be periodically refurbished to re-set, or replace the stubs. The high temperature in the stubs sometimes causes them to extrude, becoming longer and thinner over time. This also has a negative impact on assembly performance and increases the anode assembly maintenance costs. Furthermore anode assemblies in which the stubs are either thinned down or miss-aligned with the anode stub-hole have higher electrical losses due to the reduction in the contact area with the stubs. This invention addresses the problem of stub deformation and deterioration by providing a highly conductive core to transport the heat away from the stubs and by providing insulation to control the heat flow into the stubs. This way the stub temperature can be maintained in the region where plastic deformation and chemical attack can be kept to a minimum.

Preferably the top of the yoke is provided with a groove which extends into the high electrically conducting core. This groove is designed to reduce the rigidity of the yoke. The anode rod consisting of a main anode stem and at least one auxiliary anode stem is received and secured within the groove to provide electrical contact with the core of the yoke. The main anode stem is designed to be clamped into the existing anode clamps and fit into the existing anode handling equipment. The auxiliary stem is shorter and extends from below the clamps to the yoke. The auxiliary stem is preferably welded to the main stem at its top and to the yoke at its bottom. This structure, with a deep groove and dual rod construction, is elastic and it is capable of flexing to accommodate any miss match in thermal expansion between the assembly and the carbon block, without resulting in permanent deformation.

As the carbon anode is progressively consumed during electrolysis, the top and the sides of the anode are also partially consumed by air ingress under the ore cover and by $CO_2$ gas released during electrolysis. This non-electrolytic consumption of carbon not only increases the anode consumption, but also exposes the stubs to a possible exposure to molten bath. In some cases, as the anodes reach the end of their useful life and the cell has a high bath height, the anode butt can become completely submerged below the surface of the bath. In this case the top part of stubs become exposed to the molten bath and can be easily attacked by bath. The progressive dissolution of stubs damages the anode assembly, thus requiring costly maintenance and at the same time contaminates the metal produced with iron. Although the raw materials typically used in the production of aluminium contain less than 100 ppm of iron, a typical smelter produces a aluminium metal with an iron content between 0.1 and 0.2 wt. %. Most of this iron comes from anode assemblies either via formation of scale, which separates and mixes with the recycled bath or via flux wash (dissolution attack) of anode stubs.

The thermal and heat generation properties of the anode assembly of the present invention may be adjusted to exclude the possibility of flux wash even under the conditions of fully submerged anode operation. The heat extraction through the highly conductive core cools the top of the anode which reduces the amount of airburn and the possibility of stub exposure to a molten bath. Furthermore the heat extraction cools the exposed stubs to a temperature which ensures that even if the stubs were completely submerged below the surface of molten bath, a frozen cryolite ledge will form on the exposed surfaces and prevent flux wash.

In some instances, it may be preferable for the yoke to be provided without an outer protective sheath. Under these circumstances the high electrically and thermally conducting core is inserted directly into the stub of the anode.

According to this aspect of the invention, there is provided an anode assembly for conducting electrical energy to an anode of an electrolytic smelting cell comprising an anode bar of high electrically conductive material, a yoke comprising a core of highly electrically and thermally conductive material electrically and thermally connected to said anode bar, said yoke being received within anode stubs which are receivable within recesses formed in an anode block, said yoke and said stubs having substantially the same thermal expansion characteristics over the operating range of temperatures of said anode assembly.

In another aspect, the invention further provides a method of forming an anode assembly comprising the steps of forming a yoke having a high electrically and thermally conductive core and an outer structural sleeve extending at least over the ends of said core, said outer structural sheath having substantially the same thermal expansion characteristics as said core over the operating range of temperatures of said anode assembly, forming a groove in said yoke, and connecting an anode bar of highly electrically conductive material to said yoke in electrical contact with the core of said yoke.

In some instances, the applicants have found that high thermal and electrical contact between the sheath and the stubs can be maintained over the operating range of the anode assembly simply by forming a taper at the ends of the sheath and a complimentary tapered bore in the stubs. According to this aspect of the invention, there is provided an anode assembly (17) for conducting electrical energy to an anode of an electrolytic smelting cell comprising an anode bar (20) of high electrically conductive material connected to a yoke (21), the ends of the yoke (21) being receivable within anode stubs (22), said anode stubs (22) being received within said anode (C), said yoke (21) comprising a core (29) of highly electrically and thermally conductive material and an outer structural sheath (30) characterised in that the outer structural sheath (30) extends substantially the length of the yoke (21), the ends of the yoke (21) being tapered to be received within complimentary bore in said stubs (22).

The invention is also directed to a smelting cell incorporating the anode assembly described above connected to an anode beam for conducting electrical energy to the anode assembly.

The anode assembly of the present invention is able to increase the production capacity and power efficiency in existing cells through innovative anode assembly construction, better process heat extraction and more efficient use and conversion of raw materials. The anode assemblies, are substantially maintenance free and virtually process indestructible. In situations of extreme process excursions and damage, the anode assemblies of the present invention are best handled by specialised refurbishment or recycling of high value materials. These assemblies are designed to prevent being damaged and not necessarily for ease of repair of the damaged components.

BRIEF DESCRIPTION OF THE DRAWINGS

FIG. 3(*b*) is a sectional view of the stubs 22 shown in FIG. 3(*a*);

FIG. 3(*c*) is a sectional view of the yoke 29 shown in FIG. 3(*a*);

DESCRIPTION OF THE PREFERRED EMBODIMENTS

Figure 1:
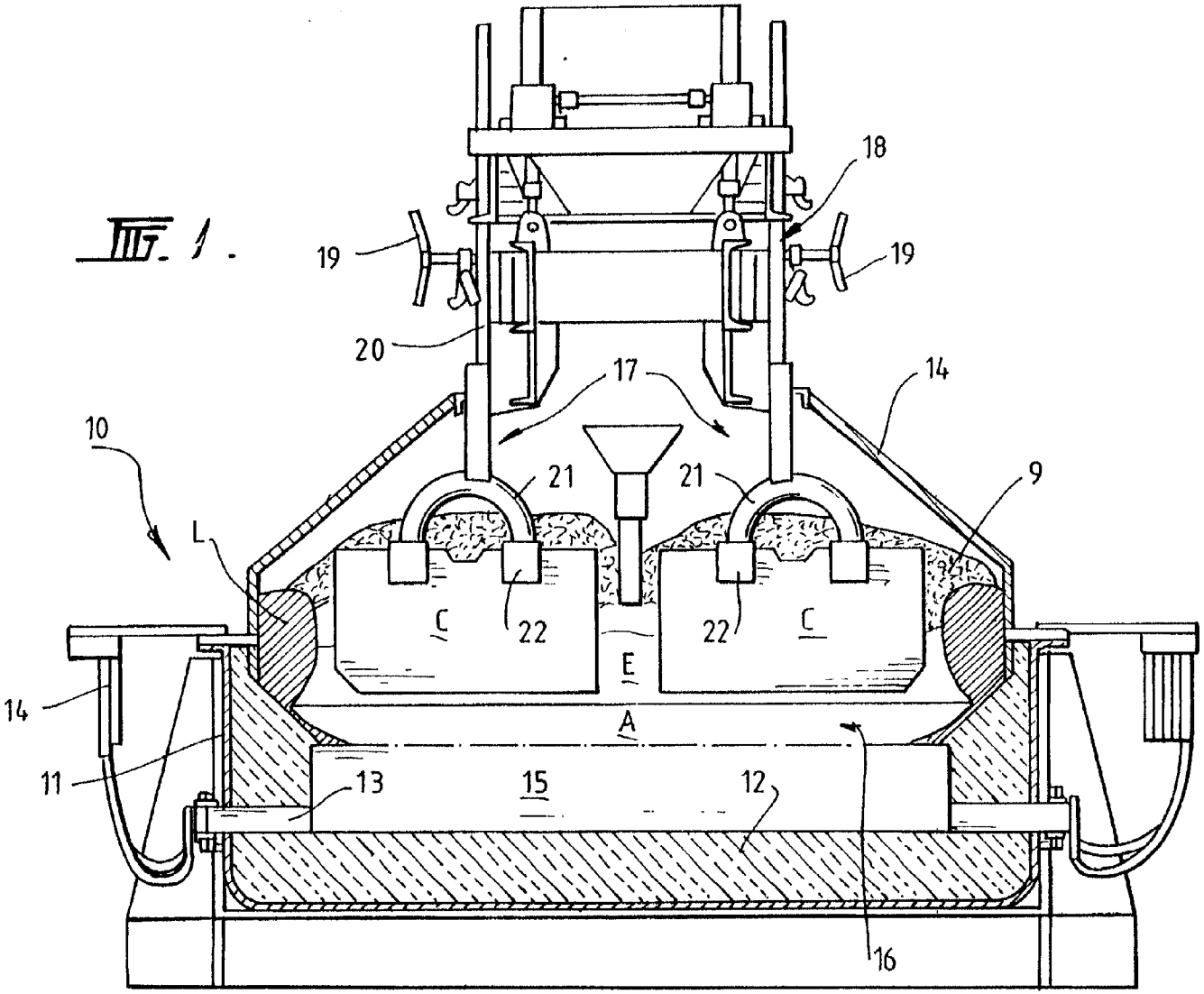
FIG. 1 is a schematic sectional view taken through a Hall-Heroult smelting cell and illustrates the anode assembly of the present invention.

An aluminium reduction cell 10 for commercial production of aluminium is illustrated in FIG. 1 illustrating the use of the anode assembly in accordance with the invention.

The electrolytic cell 10 is defined by an exterior shell 11 lined internally with insulation 12. A cathode collector bar 13 is connected to the cathode bus bar 14 (negative source of power) and embedded in cathode block 15. Molten aluminum A is contained within the walls of the cell 16 covered by a frozen cryolite ledge L. In the molten electrolyte E and within which at least partly immersed and suspended from above are one or more carbon blocks C which are attached to the anode assemblies 17 of the present invention. Solidified alumina and cryolite 9 cover the anodes C and form a crust. The anode assemblies are connected to the anode ring bus 18 (positive source of power) via anode clamps 19. The steel shell 11 of the electrolytic cell 10 is covered by conventional gas collection hood H.

Electricity is conducted to the carbon block C by an anode assembly of the present invention which is generally designated by the reference numeral 17 and specifically adapted for use during the production of aluminium via the Hall-Heroult process.

Figure 2:
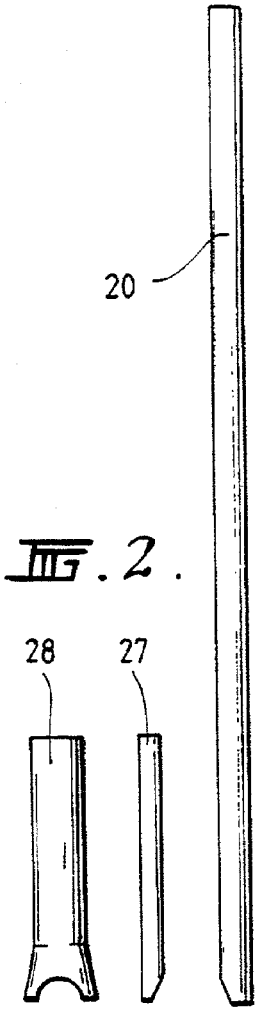
FIG. 2 an exploded view of the anode assembly in accordance with the present invention.
Figure 3A:
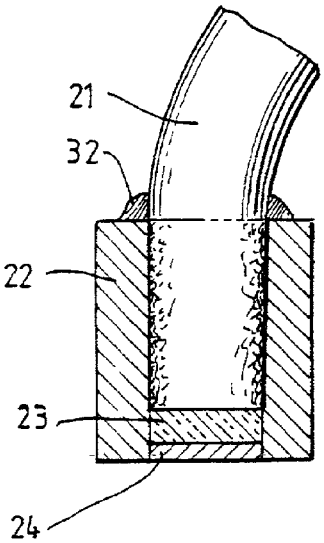
FIG. 3(*a*) is a sectional view of the anode assembly below line 3—3 of FIG. 2.
Figure 3B:
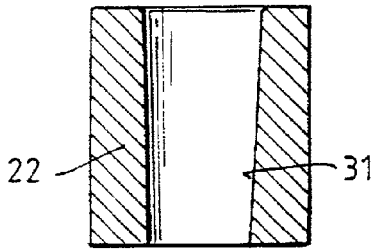
Figure 3C:
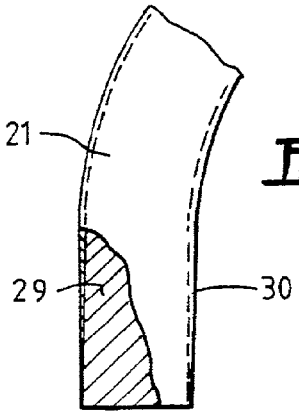

Referring to FIG. 2, the anode assembly includes an anode rod having a main anode stem 20, which is usually made of copper or aluminium and generally rectangular configuration as can be seen in FIG. 2. The anode rod is attached through main anode bar 20 to the yoke 21. The yoke comprises a core of high electrically conductive material and an outer structural sheath extending substantially the length of the yoke 21. The outer structural sheath is preferably a high temperature structural material with similar thermal expansion properties such as austenitic stainless steel. The yoke 21 supports tow hollow stubs 22 which contain an insulating disc 23 and are sealed on the bottom by a welded plug 24. As shown in FIGS. 2 and 3 the ends of the yoke are slightly tapered and metallised with a brazing compound 25. During assembly the yoke is placed into a special pressing jig (not shown) and pressed into the stubs to cause their partial expansion. A deep groove 26 is milled into the top of the yoke to enable the main stem 20 and the auxiliary anode stem 27 to be electrically connected to the core of the yoke 29. Both stems may be covered by a protective collar preferably of stainless steel which is flared at its bottom and welded to the yoke and to the stems.

Details of electrical and mechanical connection between the yoke 21 and stub 22 is shown in FIG. 3. The electrical connection between the steel stub 22 and the electrically conductive core 29 of the yoke 21 occurs via a tapered pressure fit between the outer protective sheath 30 and the machined tapered hole in the stub 31. The mechanical connection between the steel stub 22 and the yoke 21 is preferably made via a weld 32. To enhance the electrical connection and to reduce the friction during pressing operation, the outer surface 25 of the tapered part of the yoke can be metallised with a brazing compound. On subsequent heat treatment, the brazing compound melts and reacts with the mating surfaces of the stub and the tapered part of the yoke, thus enhancing the electrical connection and excluding the possibility of contact deterioration due to oxygen ingress. The separation of mechanical and electrical functions ensures that the weld on top of the stub is not weakened by the passage of current and the generation of heat. Similarly any deterioration of the quality of the welded joint between the yoke and the stubs will not result in deterioration of electrical performance of the assembly. The reduced perimeter area of the arms of the yoke combined with the highly conductive core impart cooling to the top of the stub which enables it to operate in bath under submerged conditions without suffering from stub wash.

Figure 4:
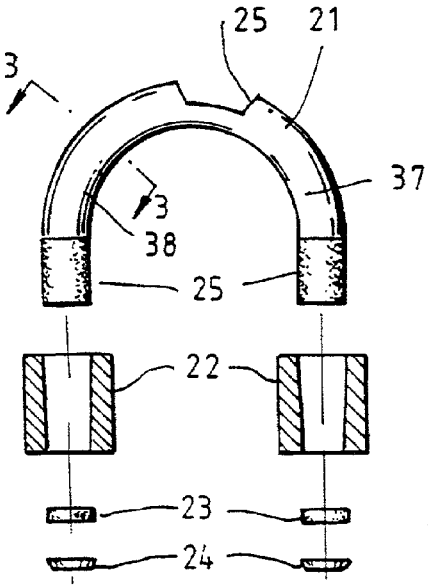
FIG. 4 is a cross sectional view of the upper part of the anode assembly in accordance with the invention.
Figure 4:
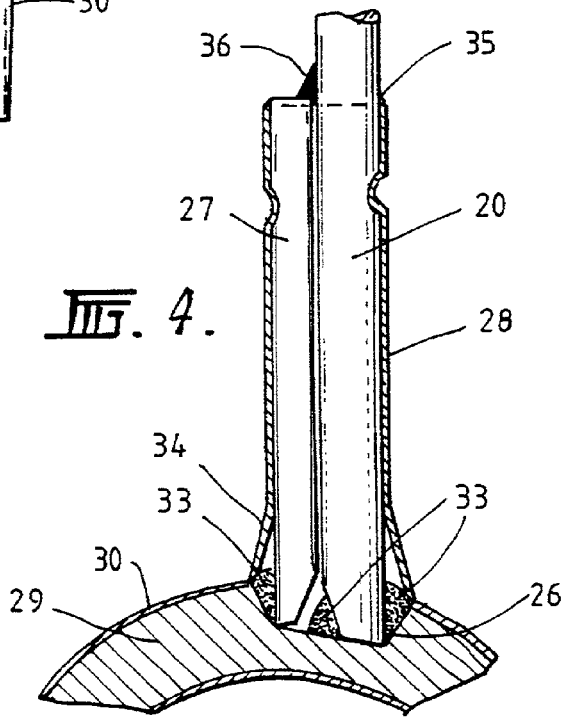

Details of the anode rod to yoke connection are illustrated in FIG. 4. The main anode stem 20 of the anode rod is first beveled for welding and inserted into the milled grove on top of the yoke. The main stem is welded to the yoke core 29 on both sides with a full penetration fillet weld 33. This is followed by insertion and welding of the auxiliary stem 27, which is welded only on one side. A specially fitting protective collar 28 having flared region 34 is slipped over both rods and welded to the outer protective sheath 30 of the yoke 21 and the top 35 of the auxiliary stem 27. The auxiliary stem is welded to the main anode stem with a full penetration fillet weld 36. The dual stem construction and the weakened structure of the yoke due to the presence of a deep grove, combined with the flared protective collar provide for inward flexing of the arms 37, 38 of the yoke 21 without leading to permanent deformation. This flexing absorbs the mismatch of the thermal expansion between the yoke 21 and anode carbon black without placing undue stress on the block.

Figure 5:
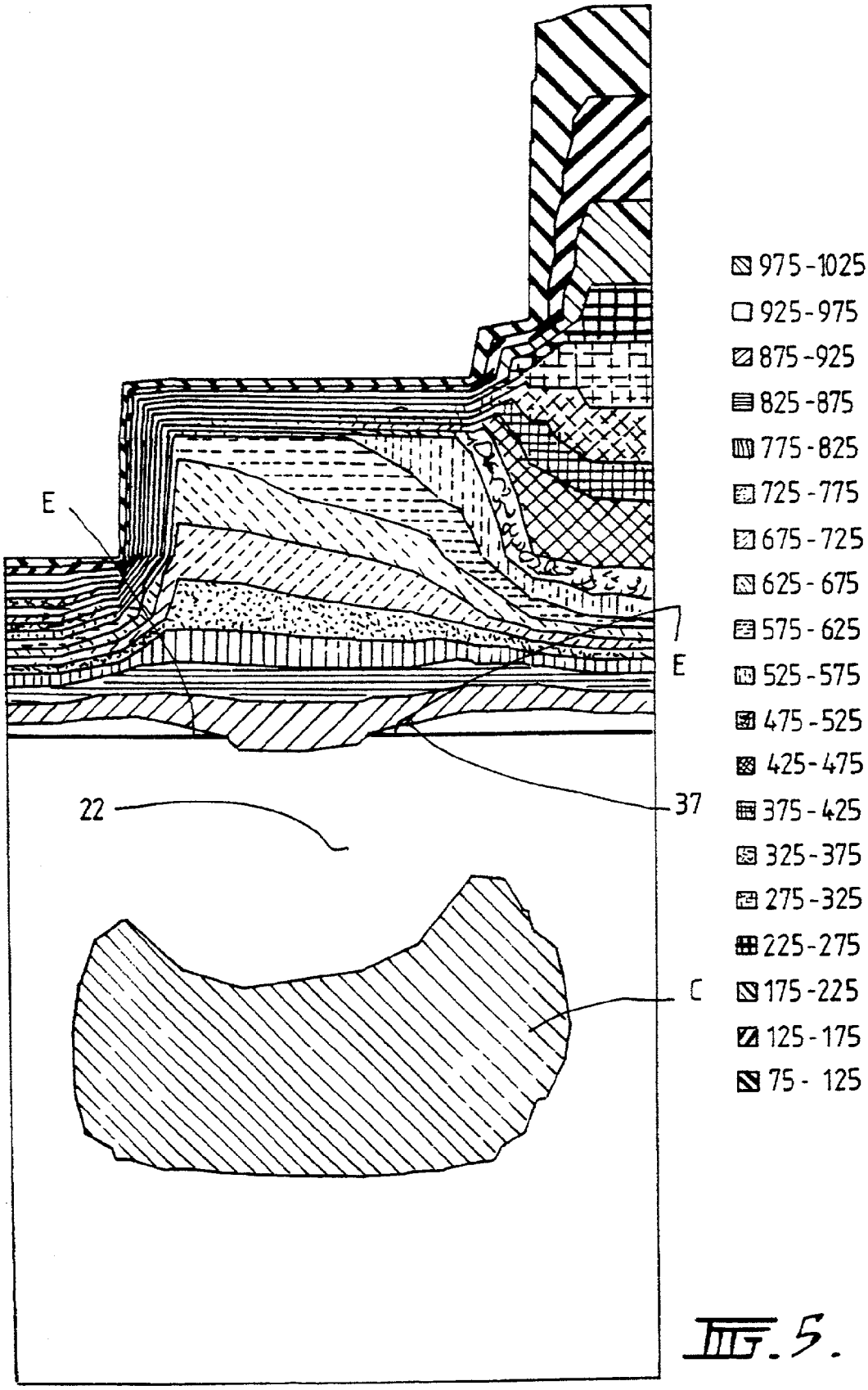
FIG. 5 is an output from a thermoelectric model showing a typical temperature distribution in a conventional anode assembly under submerged conditions.

Thermoelectric modelling results of a conventional anode assembly are shown in FIG. 5. These results illustrate that if a conventional anode assembly was to be operated such that the anode was submerged under molten bath stub 22 would be attacked. It shows that with molten bath E flooding over the top of the carbon C, the stub 22 would reach a temperature at the point of exposure 37 which is above the melting point of the bath (955° C.). Stub attack and erosion would be inevitable under these conditions.

Figure 6:
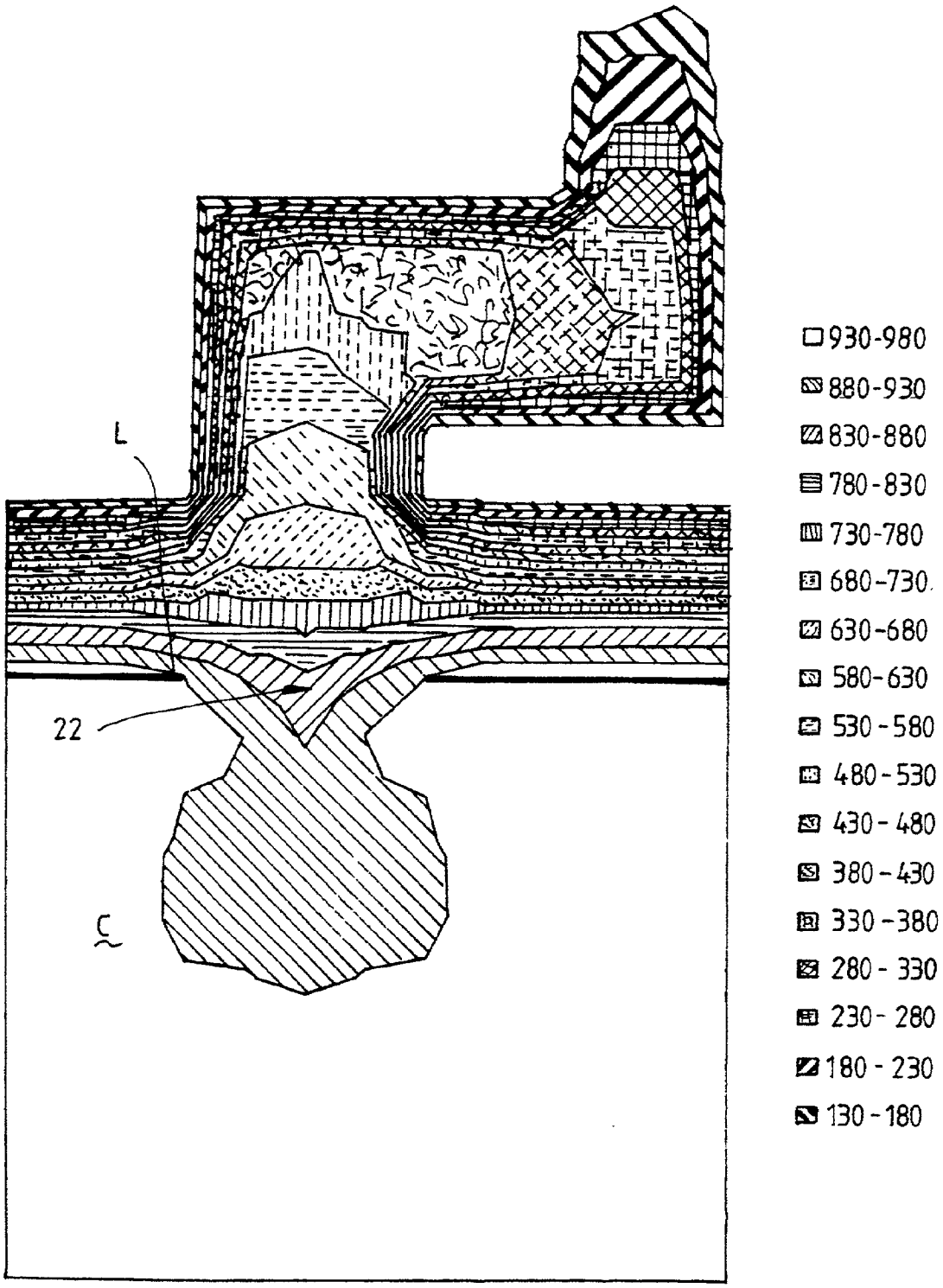
FIG. 6 is an output from a thermoelectric model showing a typical temperature distribution in an anode assembly of present invention under submerged conditions.

The results of thermoelectric modelling of an anode fitted with an assembly of present invention are shown in FIG. 6. Due to the increased conduction of heat away from the stubs 32 which occurs with the anode assembly of the invention, the results illustrate that if an anode assembly according to the present invention was used to operate an anode so that it is submerged under bath, the stub of such an assembly would not be attacked. It shows that a frozen cryolite ledge L would form on the carbon anode C surrounding the stub 22 and thus protecting the stub from any attack. The maximum temperature reached of a stub attached to an anode assembly of present invention under such conditions is 825° C. which is over 100° C. below the melting point of bath E.

For the preferred copper core, stainless steel sheath combination, the thermal and electrical conductivity properties in the typical temperature range of 200° C. to 550° C. are as follows:—

| | |
|---|---|
| Thermal conductivity | |
| Copper: | 300–360 (W/mk) |
| Stainless steel: | 18–25 (W/mk) |
| Electrical conductivity | |
| Copper: | 25–28 (l/$\mu\Omega$m) |
| Stainless steel: | 0.9–1.1 (l/$\mu\Omega$m) |
| Co-efficient of thermal expansion | |
| Copper: | $17.8 \times 10^{-6}$ mm/mmk |
| Stainless steel: | $14.6 \times 10^{-6}$ mm/mmk |

TABLE 1

| Normal Operation | | Existing | | Present invention 70 mm ins | 90 mm ins | 90 mm unins. |
|---|---|---|---|---|---|---|
| Anode Amperage | kA | 5.1 | 6 | 6 | 6 | 6 |
| Max Anode rod Temp | ° C. | 311 | 323 | 231 | 216 | 230 |
| Gusset Temp | ° C. | 397 | 443 | 248 | 230 | 245 |
| Ave Stub Temp | ° C. | 752 | 808 | 542 | 476 | 463 |
| Max Cu/Stub Temp | ° C. | 808 | 868 | 496 | 420 | 477 |
| Anode Top Temp | ° C. | 789 | 839 | 663 | 627 | 619 |
| Anode resistance | micro. ohm | 78.0 | 77.7 | 59.8 | 53.7 | 53.1 |
| Net Carbon | kgC/kgAl | 0.463 | 0.490 | 0.412 | 0.403 | 0.401 |
| Anode Power Loss | kW | 2.0 | 2.8 | 2.0 | 1.9 | 1.9 |
| Anode Heat Extraction | kW | 2.4 | 2.6 | 3.4 | 3.8 | |

Table 1 shows the summary of thermoelectric and reaction modelling comparing anode assemblies of the present invention with existing anode assemblies during normal operation. The results show that the present invention has the capacity to reduce the maximum service temperature of the critical components of the assembly by 100 to 200° C. This reduces the heat stress and chemical damage an assembly is likely to suffer during normal operations. It also shows that the maximum anode top temperature could be reduced from the present 800° C. to less than 650° C. This reduction in temperature would reduce carbon consumption by more than 10% by virtually eliminating all redundant carbon consumption. The results also predict that an anode fitted with an anode assembly of present invention would have a much lower electrical voltage loss (2 kW cf. 2.8 kW) and a much greater process heat extraction capability (4.2 vs. 2.4 kW). This means that the production of aluminium could be made more efficient due to reduced electrical losses and the production process could be intensified as the anode assembly had additional capacity to dissipate process heat.

TABLE 2

| Submarine | | Existing | | Present invention 70 mm ins | 90 mm ins | 90 mm unins. |
|---|---|---|---|---|---|---|
| Max Anode rod Temp | ° C. | 339 | 346 | 320 | 393 | 392 |
| Gusset Temp | ° C. | 476 | 485 | 349 | 428 | 428 |
| Ave Stub Temp | ° C. | 963 | 971 | 883 | 890 | 885 |
| Max Cu/Stub Temp | ° C. | 985 | 997 | 862 | 868 | 892 |
| Equivalent Heat Loss | kW | 3.7 | 3.7 | 6.3 | 8 | 8 |
| Stub wash superheat | ° C. | 11.1 | 10.1 | 25.6 | 27.4 | 26.2 |

Table 2 shows the summary of results of thermoelectric modelling comparing the anode assemblies of the present invention with existing anode assemblies during submerged operation. These modelling results show that only the anode assemblies of the present invention have the capacity to continue to operate in a submerged mode of operation. The modelling results predict that the conventional anode assemblies if submerged under liquid bath would suffer stub wash if the bath operating temperature of the cell was more that 10° C. above its liquidus temperature. As most cells operate with a superheat approaching 15° C., conventional anode assemblies are not capable of continued operation under submerged conditions. In cases where it happens by accident or as a result of excessive carbon airburn leading to exposure of stubs, the anode assemblies become damaged and require costly stub replacement.

The modelling predicts that the minimum superheat required to cause stub wash on the anode assembly of the present invention is above 25° C. As such a high superheat during normal cell operation is very rare, the anode assemblies of the present invention are unlikely to suffer damage as a result of normal process excursions.

TABLE 3

| Burn off | | Existing | Present invention 70 mm ins | 90 mm ins | 90 mm unins. |
|---|---|---|---|---|---|
| Amperage | kA | 8.4 | 14.0 | 18.1 | 15.6 |
| Ave Stub Temp | ° C. | 1009 | 952 | 962 | 932 |
| Max Cu Temp | ° C. | 1048 | 924 | 929 | 958 |
| Stub wash superheat | ° C. | 3.1 | 20.6 | 23.5 | 23.2 |
| Max Anode Rod Temp | ° C. | 505 | 343 | 390 | 387 |
| Gusset Temp | ° C. | 610 | 362 | 421 | 419 |

Table 3 shows the results of thermoelectric modelling comparing existing anode assemblies with the present invention during anode burn-off; the most stressful condition which may exist in an aluminium reduction cell. This occurs when an anode burn-off occurs. The modelling results predict that a conventional anode would burn off if its normal current leading was increased by 50%. At that point the average stub temperature would be well above the melting point of the bath, and a burn off would most probably lead to anode assembly damage. The results of modelling for the anode assemblies of the present invention, show that the burn-off threshold is much higher (14 to 18 kA cf. 8.4 kA). The critical superheat for stub wash is also predicted to remain above 20° C. This suggests that the anode assembly of the present invention, due to the specificity of its construction, would resist damage even under the most stressful of situations.

The present invention is able to provide a high performance, low maintenance anode assembly suitable for use in aluminium reduction cells. The high electrical and thermal performance was achieved through the use of a highly electrically conductive core inside a protective sheath and the use of a totally sealed design which excludes possibility for oxygen penetration of contact surfaces. Further the electrical performance was enhanced though use of high pressure contacts and brazed joints.

The present invention is able to achieve low maintenance by encasing all hot components of the assembly in a heat and chemically resistant protective sheath. Further, its mechanical robustness was enhanced through separation of the electrical and mechanical functions of the assembly such that mechanical joins are not additionally stressed by heat generated by the passage of current and electrical joins do not suffer as a result of mechanical failure.

The innovative use of ceramic fibre insulation in the stub had an additional benefit when it was accidentally discovered that the burn off threshold of the anode assembly was increased despite reduced heat losses.

What is claimed is:

1. An anode assembly for conducting electrical energy to an anode of an electrolytic smelting cell, comprising:

an anode bar of a highly electrically conductive material;

a yoke electrically connected to said anode bar;

anode stubs fitted to ends of said yoke, said yoke comprising a core of a highly electrically and thermally conductive material; and an outer structural sheath extending at least over ends of said core, wherein said outer structural sheath has substantially the same thermal expansion characteristics as the core over an operating range of temperatures of said anode assembly, and the core and the outer structural sheath are in thermal and electrical contact over substantially the entire length of the outer structural sheath.

2. The anode assembly of claim 1, wherein a high thermal and electrically conductive contact is maintained between the core and the sheath over the operating range of temperatures of said anode assembly.

3. The anode assembly of claim 1 or 2, wherein the core is produced from a metal having electrical and thermal conductivities in the ranges of 5–70 ($1/\mu\Omega$m) and 84–400 W/mK, respectively.

4. The anode assembly of claim 3, wherein the core and sheath are produced from a combination of metals whose differential coefficient of thermal expansion does not exceed $4\times10^{-6}$ m/mK.

5. The anode assembly of claim 4, wherein the sheath is produced from a material selected from the group consisting of austenitic stainless steel, ferritic stainless steel, spheroidal graphite iron and carbon steel.

6. The anode assembly of claim 3, wherein the core is produced from a material selected from the group consisting of high purity, aluminum, copper and nickel.

7. The anode assembly according to claim 1, wherein the yoke is substantially U-shaped and the outer protective sheath extends substantially the length of said core.

8. The anode assembly according to claim 7, wherein the anode bar comprises a main anode stem and an auxiliary anode stem, and the auxiliary stem extends substantially the length of the structural collar of the anode bar.

9. The anode assembly of claim 8, wherein the auxiliary anode stem and the main anode stem are secured together, the auxiliary anode stem is sealed within the outer protective collar and the main anode stem extends from said collar for connection to an anode bus bar.

10. The anode assembly according to claim 1, wherein the outer structural sheath has substantially the same thermal expansion characteristics as the stubs over the operating range of temperatures of the anode assembly.

11. The anode assembly according to claim 1 or 10, wherein the ends of the yoke are tapered and the anode stubs are provided with a tapered bore adapted to receive the tapered ends of said yoke.

12. The anode assembly according to claim 1, wherein an air gap or an insulating plug is maintained in the bore of said anode stub below said yoke when the yoke is pressed into said stubs.

13. The anode assembly according to claim 1, wherein the outer sheath of the yoke and the protective collar are formed from a high temperature structural austenitic steel.

14. A method of forming an anode assembly comprising:

forming a yoke having a highly electrically and thermally conductive core;

forming an outer structural sheath extending at least over ends of said core, said outer structural sheath having substantially a same thermal expansion characteristics as said core over an operating range of temperatures of said anode assembly;

forming a groove in said yoke; and connecting an anode bar of highly electrically conductive material to said yoke such that said anode bar is in electrical contact with the core of said yoke.

15. The method of claim 14, wherein the core is produced from a material having electrical and thermal conductivities in the ranges of 5–70 ($1/\mu\Omega$m) and 80–400 W/mK respectively.

16. The method of claim 14, wherein the yoke is formed in a substantially U-shaped configuration and the outer structural sheath of the yoke extends substantially the length of said core.

17. The method of claim 16, further comprising securing a structural collar to the outer structural sheath of said yoke such that the anode bar extends through said collar.

18. The method of claim 17, wherein the outer protective collar surrounding said anode rod is sealed.

19. The method claim 18, wherein the yoke is initially pressed into protective anode stubs and said stubs are able to be pressed into recesses formed in the anode where the anode assembly is press fitted into said anode.

20. The method of claim 19, further comprising:

forming a taper in the ends of the yoke to compliment a tapered bore formed in the anode stubs, and securing the stubs to the ends of the yoke by press forming the ends into the anode stubs.

21. The method of claim 20, wherein the anode stubs are provided with a plug and an insulating disc between the plug and the ends of the yoke when the yoke is pressed into the anode stubs.

22. The method of claim 20, wherein an air gap exists between the ends of the lower most part of the stubs when the yoke is pressed into the anode stubs.

23. The method of claim 14, wherein the core and the sheath are produced from a combination of materials whose differential co-efficient of thermal expansion does not exceed $4\times10^{-6}$ m/mK.

24. An anode assembly for conducting electrical energy to an anode of an electrolytic smelting cells comprising:

an anode bar of high electrically conductive material;

a yoke comprising a core of a highly electrically and thermally conductive material, said core being electrically and thermally connected to said anode bar, and said yoke being received within anode stubs which are receivable within recesses formed in an anode block;

wherein said yoke is in thermal and electrical contact over substantially the entire length of the stub and said yoke and said stubs have substantially the same thermal expansion characteristics over the operating range of temperatures of said anode assembly.

25. The anode assembly of claim 24, wherein the core is produced from a metal having electrical and thermal conductivities in the ranges of 5–70 ($1/\mu\Omega$m) and 80–400 W/mK respectively.

26. The anode assembly of claim 24, wherein the yoke and the stubs are produced from a combination of metals whose differential co-efficient of thermal expansion does not exceed $4\times10^{-6}$ m/mK.

27. The anode assembly according to claim 26, wherein the ends of the yoke are tapered and the recesses in the anode stubs are provided with a tapered bore adapted to receive the tapered ends of said yoke.

28. An anode assembly for conducting electrical energy to an anode of an electrolytic smelting cell, comprising:

an anode bar of a highly electrically conductive material connected to a yoke, wherein ends of the yoke are receivable within anode stubs and said anode stubs are received within said anode, and wherein said yoke comprises a core of a highly electrically and thermally conductive material and an outer structural sheath, the outer structural sheath extends substantially the length of the yoke and the ends of the yoke are tapered to be received within a complimentary bore in said stubs.

29. The anode assembly of claim 28, wherein the anode rod is provided with a protective structural collar secured to the outer structural sheath of the yoke.

30. The anode assembly of claim 28, wherein the outer structural sheath comprises a material having substantially the same thermal expansion characteristics as the core over the operating range of temperatures of said anode assembly.

31. A smelting cell comprising an anode assembly of claim 1 or 28, and an anode beam connected to said anode assembly for conducting electrical energy to the anode bar of said anode assembly.

32. An anode assembly for conducting electrical energy to an anode of an electrolytic smelting cell, comprising:

an anode bar of a highly electrically conductive material;

a substantially U-shaped yoke electrically connected to said anode bar;

anode stubs fitted to ends of said yoke, said yoke comprising a core of a highly electrically and thermally conductive material; and an outer structural sheath extending substantially the length of said core, wherein said outer structural sheath has substantially the same thermal expansion characteristics as the core over an operating range of temperatures of said anode assembly.

33. The anode assembly according to claim 32, wherein the anode bar comprises a main anode stem and an auxiliary anode stem, and the auxiliary stem extends substantially the length of the structural collar of the anode bar.

34. The anode assembly of claim 33, wherein the auxiliary anode stem and the main anode stem are secured together, the auxiliary anode stem is sealed within the outer protective collar and the main anode stem extends from said collar for connection to an anode bus bar.

35. The anode assembly according to claim 32, wherein an air gap or an insulating plug is maintained in the bore of said anode stub below said yoke when the yoke is pressed into said stubs.

36. The anode assembly according to claim 32, wherein the outer sheath of the yoke and the protective collar are formed from a high temperature structural austenitic steel.

* * * * *